United States Patent [19]

Das

[11] 3,935,955

[45] Feb. 3, 1976

[54] CONTAINER BOTTOM STRUCTURE

[75] Inventor: Salil K. Das, Hickory Hills, Ill.

[73] Assignee: Continental Can Company, Inc., New York, N.Y.

[22] Filed: Feb. 13, 1975

[21] Appl. No.: 549,623

[52] U.S. Cl. ..... 215/1 C; 220/70

[51] Int. Cl.[2] ..... B65D 1/02

[58] Field of Search ..... 215/1 C; 220/70

[56] References Cited

UNITED STATES PATENTS

| | | | |
|---|---|---|---|
| 3,038,627 | 6/1962 | Daley | 220/70 X |
| 3,598,270 | 8/1971 | Adomaitis | 215/1 C |
| 3,871,541 | 3/1975 | Adomaitis | 215/1 C |

*Primary Examiner*—Donald F. Norton

*Attorney, Agent, or Firm*—H. Lawrence Smith; Joseph E. Kerwin; William A. Dittmann

[57] ABSTRACT

An improved bottom structure for plastic bottles of the type suitable for containing carbonated beverages. The outer surface of the bottom structure is formed with a central concave dome portion and a number of radial foot portions extending axially outwardly. The radial profile of each foot portion is a curve which merges with the dome portion and with the side wall of the container and which comprises a plurality of tangential arcs in series. Also disclosed is an improved mold for forming such bottom structures.

15 Claims, 7 Drawing Figures

FIG. 7
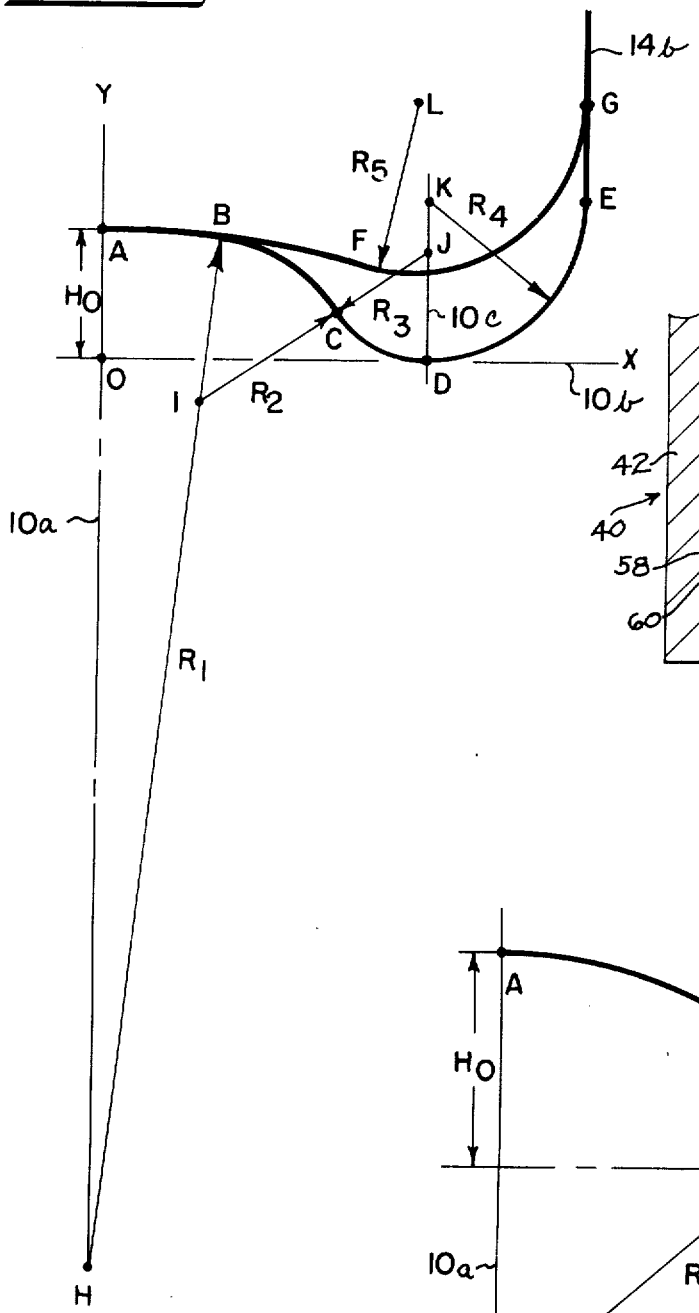
FIG. 5
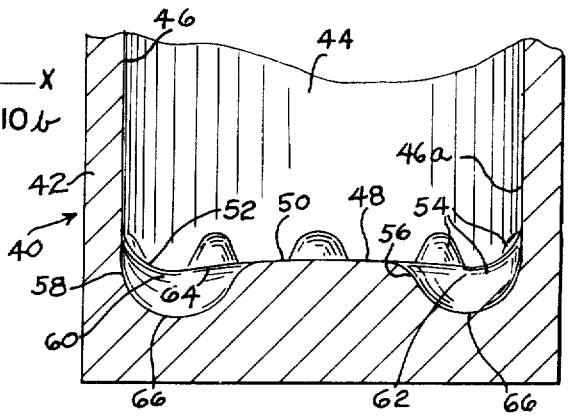
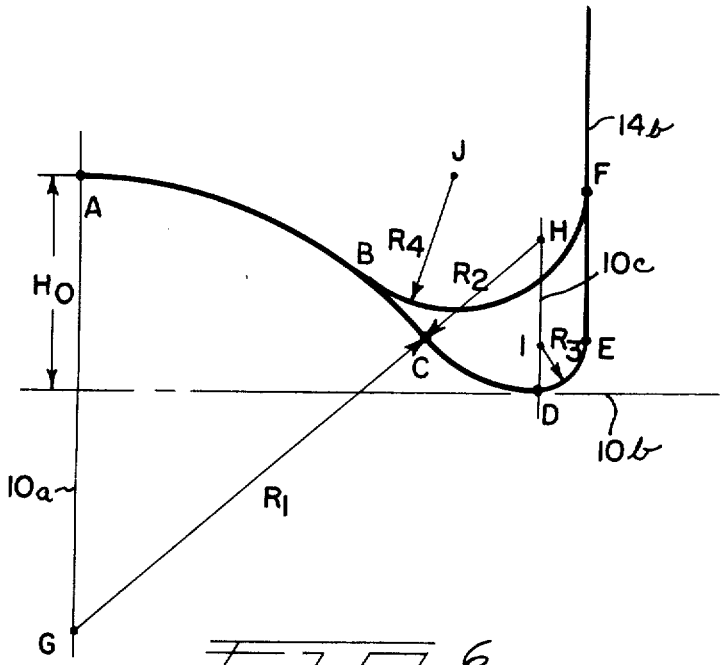
FIG. 6

CONTAINER BOTTOM STRUCTURE

BACKGROUND OF THE INVENTION

This invention relates to bottom structures for containers, and more particularly, to improved bottom structures for plastic bottles of the type suitable for containing effervescent or carbonated beverages.

The bottling of carbonated beverages in plastic presents a number of problems, many of which arise in connection with the base or bottom structure of the bottle. Mere duplication in plastic of traditional glass bottom configurations is unsatisfactory because of the tendency of plastics to creep or become distorted under pressure, especially in the presence of the elevated temperatures which may be encountered during shipment and storage. Such distortion may alter the shape and dimensions of traditional bottom configurations to the extent that the level of liquid within the bottom falls below the fill line, thereby threatening customer acceptance or satisfaction, and the bottle may become a so-called rocker; that is, it may become unstable on a horizontal surface, with the probability of similar adverse reaction on the part of the customer.

On the other hand, it is frequently desirable that the inner and outer shapes and dimensions of plastic bottles approximate those of glass bottles of the same capacity so that they may be handled by existing equipment and, in certain instances, assist customer identification of the particular product they contain. In any event, they should be aesthetically attractive.

A plastic bottle, when filled with a carbonated beverage and capped, must be able to withstand the impact of falling from at least a moderate height onto a hard surface, and the precipitous rise in internal pressure which accompanies the impact. While this requirement also affects selection of materials and bottleforming techniques, it is an extremely important consideration in the contemplation of bottom design.

Finally, the optimum bottom structure is one which not only meets the foregoing criteria but which may be readily formed with an economy of material, without unduly expensive or elaborate equipment, and without intricate or additional manufacturing steps.

The copending U.S. patent application Ser. No. 335,974, now U.S. Pat. No. 3,871,541 filed Feb. 26, 1973 in the name of D. Adomaitis and assigned to the assignee of the present invention, discloses a container in which the outer surface of the bottom structure comprises, briefly, a central concave dome portion, a convex annular rim portion circumscribing the dome portion and merging therewith and with an adjacent cylindrical portion of the side wall of the container, and a radial array of convex foot portions extending axially outwardly of the rim portion. Each of the foot portions merges at its radially inner end with the dome portion, at its radially outer end with the side wall, and at its lateral margins with the rim portion to form a shallow rib portion between adjacent foot portions.

Noting that plastics are weakest in tension, such a construction exposes the dome portion to compressive stresses only, and among other advantages, arrests the tensile and flexural stresses at the base of the dome portion while permitting an economy of material in forming the bottom structure.

In the prior application, the dome portion is shown to be a segment of a sphere (the sphere being commonly recognized as the optimum pressure-bearing surface), whereby the radial profile of the outer surface of the dome portion comprises a concave arc having its center of curvature on the central axis of the bottle. The radial profile of the outer surface of each foot portion comprises a single convex outer arc tangential to the inner arc of the dome portion and to the cylindrical side wall portion. The axially outermost point of the latter arc comprises a support point for the bottle when it is at rest on a horizontal surface in an upright position. As is readily apparent, in order effectively to distribute and dissipate the forces arising from internal pressures and/or impact with a hard surface, curved surfaces are used virtually throughout the bottom structure, and to avoid undue stress concentrations, adjacent surface portions are smoothly merged or blended with each other.

It has been found that the stresses arising in such a bottom structure may be reduced by increasing the radius of curvature of the arc of the foot portion. However, as this radius is increased, the support point is moved inwardly toward the central axis of the bottle, and the bottle therefore tends to become less and less stable when supported on a horizontal surface. Upright stability is especially critical in the case of certain types of bottle conveying equipment presently in use.

If, on the other hand, the radius of the arc of the foot portion is made smaller to enhance stability, and the radius of the arc of the dome portion thereby increased, the material of the dome portion must be made thicker to avoid snap buckling; that is, the sudden eversion of the dome portion under pressure. A further problem arises in that the radially outer end of the foot portion becomes an increasingly sharp corner as the radius of the outer arc decreases in length. In blowmolding it becomes more and more difficult to fill the corresponding corner of the mold. Still further, capacity is reduced and more material is required, or still more material must be used to achieve similar capacity.

SUMMARY OF THE INVENTION

In accordance with the present invention, the profile of the outer surface of the foot portion comprises a curve tangent to the radial profile of the dome portion and to the profile of the side wall, the latter curve comprising a plurality of tangential arcs in series rather than the single convex outer arc of the aforementioned prior application.

Such a construction permits wide latitude in designing the bottom structure to meet the sometimes conflicting requirements discussed hereinabove while taking advantage of the beneficial properties inherent in the basic dome-and-foot configuration.

Specific objects, features and advantages of the invention will be apparent from the ensuring description taken in conjunction with the accompanying drawings.

THE DRAWINGS

In the accompanying drawings:

FIG. 5 is a fragmentary, longitudinal sectional view of a mold suitable for use in forming the bottle of FIG. 1;

FIG. 6 is a diagrammatic representation of two radial profiles, one superimposed on the other, of a bottle bottom structure which comprises one embodiment of the invention; and FIG. 7 is a diagrammatic illustration similar to FIG. 6 but representing a bottle bottom structure which comprises another embodiment of the invention.

THE PREFERRED EMBODIMENTS

Figure 1:
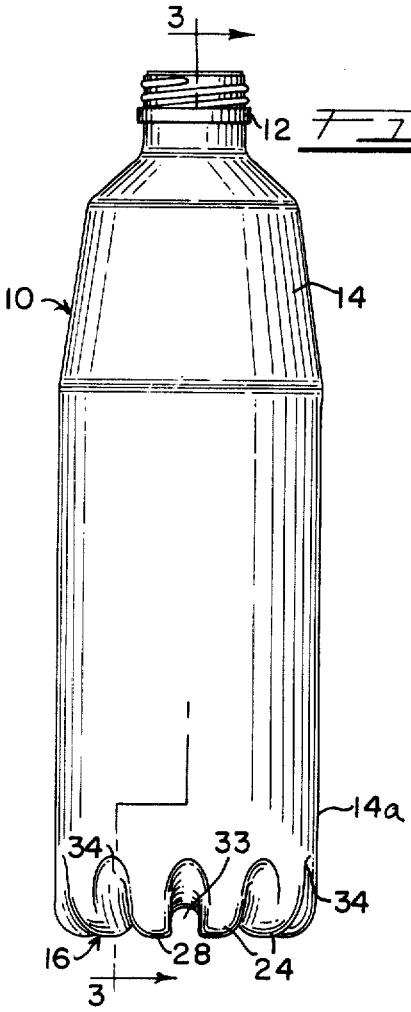
FIG. 1 is a side elevational view of a container comprising a bottle constructed generally in accordance with the invention.
Figure 2:
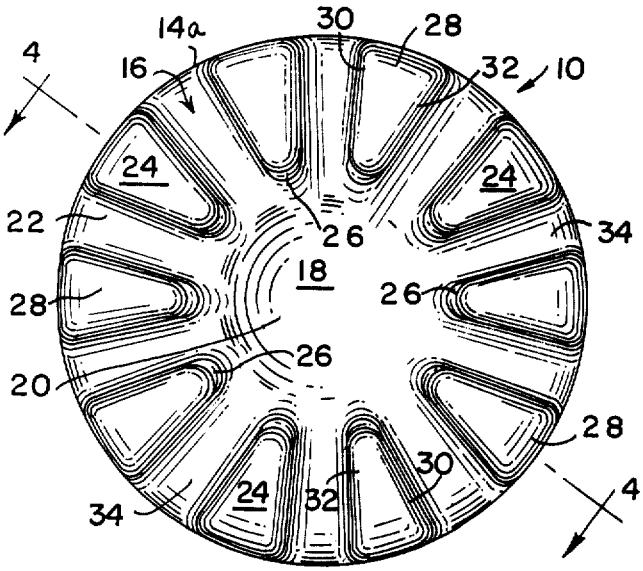
FIG. 2 is a greatly enlarged bottom plan view of the bottle of FIG. 1.

Referring to FIGS. 1 to 4, a container in the form of a bottle 10 is constructed generally in accordance with the invention and is preferably formed of a thermoplastic material having gas barrier properties to a degree such that the bottle will be suitable for containing an effervescent or carbonated beverage at least throughout expected shelf time; that is to say, the period from bottling to consumption. A number of materials of this type have been developed; among them, for example, are those identified by the trademarks "Cycopac 910", produced by Borg-Warner Corporation, and "Barex 210", produced by Vistron Corporation. The bottle is blow-molded from an extruded or injection-molded preform or parison and has preferably been so worked that the material is biaxially oriented.

Bottle 10 is provided with an upper neck portion 12 having any desired neck finish, such as the threaded finish shown. A side wall 14 of any suitable form extends from the neck portion to a bottom structure, indicated generally at 16, which closes the lower end of the side wall. An end portion 14*a* of the side wall adjacent to the bottom structure is preferably formed with a cylindrical outer surface, although other forms, generally symmetrical about the central upright axis of the bottle, may be substituted.

The outer surface 18 of bottom structure 16 includes a central concave dome portion 20 of substantially spherical form; that is, it conforms generally to a segment of a sphere. A convex annular rim portion 22 of surface 18 circumscribes the dome portion, merging at its radially inner margin with the dome portion and at its radially outer margin with side wall portion 14*a*.

Figure 3:
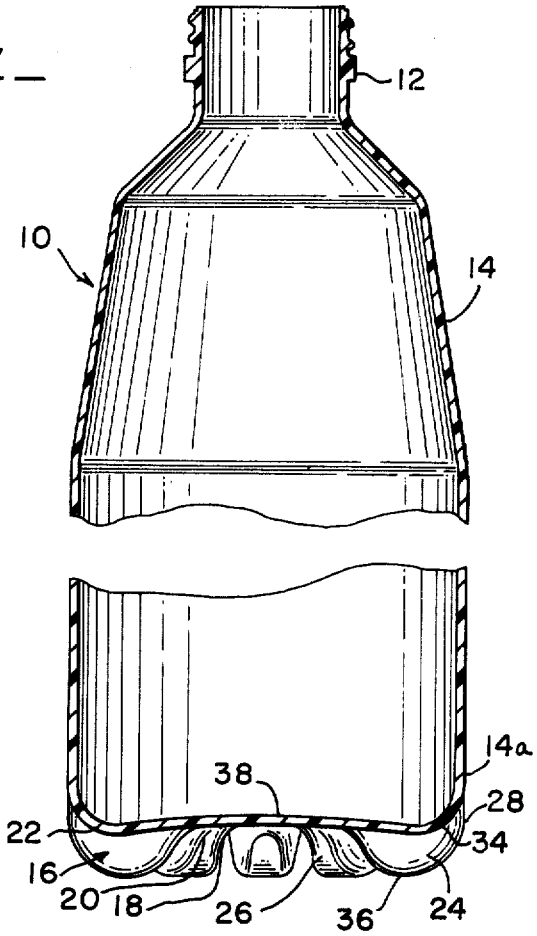
FIG. 3 is an enlarged fragmentary sectional view of the bottle of FIG. 1 taken along the line 3—3 thereof.
Figure 4:
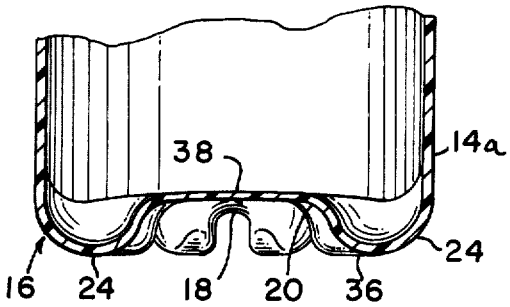
FIG. 4 is an enlarged fragmentary sectional view of the bottle of FIG. 1 taken along the line 4—4 of FIG. 2.

A plurality of radially arrayed and oriented convex foot portions 24 extend axially outwardly of rim portion 22, as best viewed in FIG. 3. While 10 such foot portions are shown (FIG. 2), the number may be as low as three (the minimum number which will provide stable support on a planar surface), and the maximum number is limited only by the overall dimensions and wall thickness of the bottom structure, the preferred range being from six to twelve, inclusive.

Each foot portion 24 has a relatively narrow radially inner end 26 merging with dome portion 20 and a relatively wide radially outer end 28 merging with side wall portion 14*a*. Each foot portion also has a pair of lateral margins 30,32 diverging radially outwardly and merging with rim portion 22 to define an arched groove 33 (FIG. 1) between each pair of adjacent foot portions and to form a shallow reinforcing or stiffening rib portion 34 therebetween. The rib portion at its radially inner end merges with dome portion 20 and at its radially outer end with side wall portion 14*a*.

An axially outermost point 36 (FIGS. 3 and 4) of each foot portion 24 lies in a plane common to the outermost points of the other foot portions, the plane being normal to the central axis of bottle 10, whereby the bottle may be supported at points 36 on a horizontal surface in an upright position.

The inner surface 38 of bottom structure 16 may take any suitable form and may be selected to provide variations in the thickness of the material forming the bottom structure; for example, in the manner disclosed and for the purposes explained in the aforementioned copending patent application.

Turning now to FIG. 5, there is shown a portion of a matrix in the form of a mold 40 suitable for use in blow-molding the bottle of FIGS. 1 to 4.

The body 42 of the mold may be made up of two or more separable elements and may take any one of a number of known forms adapted to facilitate the forming process and assist ready removal or ejection of the molded bottle. Mold inserts may be provided in known manner to achieve special or unusual side wall configurations and various neck finishes.

An interior surface of mold body 40 defines a female mold cavity 44 and is, obviously, complementary to the outer surface of the bottle to be molded. Mold cavity 44 is bounded in part by a side wall 46 of the interior surface and by a bottom surface portion 48 contiguous with the side wall at an adjacent end portion 46*a* thereof.

Bottom surface portion 48 includes a central convex dome portion 50 of substantially spherical form, and a concave annular rim portion 52 merging with the dome portion and with side wall portion 46*a*.

A plurality of concavities 54, corresponding to the foot portions 24 of bottle 10, extend axially outwardly of rim portion 52 in a radial array. As do foot portions 24 as viewed in FIG. 2, each concavity 54 has a relatively narrow radially inner end 56 merging with dome portion 50, a relatively wide radially outer end 58 merging with side wall portion 14*a*, and a pair of lateral margins 60,62 diverging radially outwardly and merging with rim portion 52 to form a rib portion 64 between each pair of concavities 54. Each rib portion so formed merges at its radially inner end with dome portion 50, and at its radially outer end with side wall portion 46*a*.

The axially outermost points 66 of the concavities 54 lie in a common plane normal to the longitudinal axis of mold cavity 44.

The use of female molds in the blow-molding of containers is well known. Briefly, a preform or parison at an appropriate temperature is received or enclosed in the mold cavity and expanded until its outer surface engages and conforms to the interior surface of the mold. Expansion is effected by creating an imbalance in the respective pressures acting on the inner and outer surfaces of the parison, as by introducing a gas under pressure to the interior of the parison or by drawing a vacuum about its exterior.

Bottom surface portion 48 of the mold may be defined in part by an end surface of a reciprocably movable piston or stem (not shown) which is actuated to enter the mold cavity when the parison is received or enclosed therein, the end surface of the piston engaging the nearest surface of the parison before and/or during expansion. An example of such an arrangement is disclosed in U.S. Pat. No. 3,412,186, issued Nov. 19, 1968 to T. Piotrowski. While the piston end surface may, if desired, be machined to conform to the configuration of mold dome portion 50, of which it forms a central element when the piston is fully withdrawn from the mold cavity, its use may result in small and centrally located deviations from the design configuration of bottle dome portion 20. Such deviations have negligible effect on the properties of the bottle and are well within the purview of the invention.

For any given bottle material and forming process, determination of a particular bottom configuration in accordance with the invention will be guided by desiderata affecting upright stability, impact strength, resistance to internal pressure, capacity, internal and external dimensions, aesthetic quality, economy of material, and adaptability to the forming process. Various considerations touching upon these characteristics are discussed hereinabove, FIGS. 6 and 7, together with the ensuing description, illustrate the flexibility which the invention affords the designer in deriving a satisfactory structure from the parameters selected.

It will be readily apparent that the profiles represented in FIGS. 6 and 7, while described with reference to the outer surface of the bottom structure of a bottle, are applicable to the interior bottom surface portion of the corresponding mold as well. However, the terms "convex" and "concave" will, of course, be reversed in the case of the mold.

FIG. 6 represents a specific embodiment of the invention in the form of two radial profiles of the outer surface of the bottom structure taken at separate angular locations. Also shown is a portion of the profile **14*b*** of the outer surface of the adjacent side wall end portion.

More particularly, a first profile ACDE extends radially from the central upright axis **10*a* of the bottle through the axially outermost point D of one of the foot portions to side wall profile 14*b*, and is superimposed on a second profile ABF of one of the rib portions, the latter profile also extending radially from the axis to the side wall profile. An interrupted line 10*b* represents the plane which contains the axially outermost points of the foot portions and therefore intersects axis 10*a*** at right angles therewith.

The central dome portion of the outer surface is preferably spherical, whereby its radial profile is a concave arc AB or AC normal to the axis at its point of intersection A therewith, and having its center of curvature G located on the axis. Point B is located on arc AC whereby arc AB is merely a segment of arc AC.

It is to be noted that the term "arc" is used throughout this specification in its special sense as meaning a continuous portion of a circle; that is, a curved line having a constant radius of curvature. The word "curve", on the other hand, is used as a generic term, and a curve may therefore consist of a single arc or a plurality of arcs arranged in a continuous tangential series and having radii of curvature of various lengths.

The radial profile of the foot portion comprises a curve CDE tangent to arc AC at point C and to side wall profile **14*b*** at point E. Curve CDE, in turn, is formed by a pair of convex arcs CD and DE tangent to each other at point D and having centers of curvature H and I, respectively.

The radial profile of the rib portion comprises a curve BF tangent to arc AB at point B and to side wall profile **14*b*** at point F. Curve BF is shown as a single convex arc having a center of curvature J, but may be formed of a plurality of arcs.

Side wall profiles **14*b*** is shown as a straight vertical line, indicating that the side wall end portion is cylindrical in this instance.

In arriving at the particular bottom configuration represented in FIG. 6, upright stability was first considered. As is obvious, the greater the distance between axis **10*a* and point D, the greater will be the stability of the container when supported on a horizontal surface. When this distance has been selected, the length of radius $R_3$ of arc DE is established as the distance between point D and side wall profile 14*b* when the latter is extended to plane 10*b*, and point I may be fixed in accordance with elementary and self-evident geometric methods. Similar methods will be equally self-evident in the placement of other points and in the construction of the various arcs represented in FIGS. 6 and 7.**

It should be pointed out that while radius $R_3$ may be quite small in accordance with the invention, if it is made too small, impact resistance in the vicinity of arc DE may be reduced to an unacceptable level.

As has been pointed out in connection with the aforementioned copending application, if the radial profile of the foot portion consists of a single arc, and the radius of the single arc is reduced to enhance stability, the material of the dome portion must be made thicker to preclude eversion under pressure, it becomes difficult to fill the corresponding sharp corner of the mold, capacity is reduced, and a greater amount of material is required. These disadvantages are eliminated in the construction of FIG. 6, in spite of the reduced length of radius $R_3$, by including arc CD as a second arc in the profile of the foot portion and by fixing the length of its radius $R_2$ at a value substantially greater than that of radius $R_3$. Thus, the two arcs CD and DE respectively provide the advantages of a large radius and a small radius, a condition patently impossible to achieve if the foot portion profile consists of a single arc.

The length of radius $R_2$ is selected to establish the depth of the rib portion; that is, the average distance between arc BF and curve CDE, at a value which will provide a substantial stiffening effect. Also, as the length of radius $R_2$ is increased, the distance CE is increased, whereby the stiffening effect of the rib portion is applied over a greater area.

The length of radius $R_2$ is dependent to some extent on the value selected for the maximum height $H_o$ of the dome portion above plane **10*b***. As height $H_o$ decreases, the possibility of eversion is increased; as height $H_o$ increases, capacity decreases and more material is called for.

When height $H_o$ and radius $R_3$ have been determined, the length of radius $R_1$ of arc AC (and thus of its segment AB) and the location of its center of curvature G are established. Center of curvature H of arc CD is located on a line **10*c* which is parallel with axis 10*a*** and which also includes point I. With this construction arcs CD and DE are tangent at the axially outermost point D of the foot portion, whereby to effect an economy of material for a given capacity without reduction of impact strength at the outermost point of the foot portion, this frequently being the point of impact.

The location of point F, the point of tangency of arc BF with side wall profile **14*b***, is based on two considerations: as it is placed higher on the side wall, aesthetic quality is lessened and capacity is reduced; as it is placed lower, the depth of the rib portion is reduced and its stiffening effect is diminished. When the location of point F has been selected, the length of radius $R_4$ of arc BF and the location of its center of curvature J are established.

It is to be noted that in the construction of FIG. 6, the point of tangency C of arc AC with arc CD lies at a greater distance from axis 10*a* than the point of tangency B of arc AB with arc BF. This results in a relatively great effective length of the stiffening rib portion.

In FIG. 7, which represents an alternative embodiment of the invention, the reference characters 10*a*, 10*b*, 10*c* and $H_o$ identify elements and quantities similar to those identified by the same reference characters in FIG. 6.

Referring to FIG. 7, a first profile ABCDE of the outer surface of the bottom structure extends radially from axis 10*a* through the axially outermost point D of one of the foot portions to side wall profile 14*b*, and is superimposed on a similarly drawn second profile AFG through one of the rib portions. The central dome portion of the outer surface is preferably spherical, as in the embodiment of FIG. 6, whereby its radial profile is a concave arc AB or AF having its center of curvature H on axis 10*a*. Point B is located on arc AF whereby arc AB is a segment of arc AF.

The radial profile of the foot portion comprises a curve BCDE tangent to arc AB at point B and to side wall profile 14*b* at point E. Curve BCDE is formed of three arcs in series, namely a concave arc BC and a pair of convex arcs CD and DE. Arcs BC and CD are tangent to each other at point C, and arcs CD and DE at point D. Arcs BC, CD and DE have centers of curvature I, J and K, respectively.

The radial profile of the rib portion comprises a curve FG tangent to arc AF at point F and to side wall profile 14*b* at point G. Curve FG is shown as a single convex arc having a center of curvature L, but may consist of a tangential series of arcs.

The configuration of the bottom structure represented in FIG. 7 has been devised to provide relatively great resistance to impact and internal pressure, with an economy of material and at the expense of some degree of upright stability. Accordingly, the distance BE is made relatively large to reduce stresses and to enlarge the area subject to the stiffening effect of the rib portion. Dome height $H_o$ is reduced to conserve material (or to enlarge capacity), but the radius $R_1$ of arc AF (and thus of arc AB) is lengthened considerably to provide a rib portion having substantial depth.

In order to achieve relatively large values for both the distance BE and the length of radius $R_1$, the length of radius $R_4$ of arc DE is made as large as is compatible with stability requirements, and the concave arc BC is included in the foot portion profile.

Maximum stresses can be expected to arise in the vicinity of point C; however, as the length of radius $R_3$ of arc CD is made smaller, the height of point C above plane 10a is reduced, thus increasing the distance between point C and rib portion profile FG and, as a result, enhancing the stiffening effect of the rib portion in the high-stress area. It will be noted that in the construction of FIG. 7, radius $R_3$ is smaller in length than radius $R_4$. However, this relationship may be reversed; it may be particularly desirable to do so in the case of thin-walled containers formed of high-strength materials such as the metals mentioned hereinbelow.

The location of point G is selected not only on the basis of aesthetic considerations but is placed low enough on the side wall profile that flow of material to the foot portion is unimpeded during the blow-molding operation, yet high enough that the depth of the rib portion is substantial.

In the embodiment of FIG. 7, the point of tangency F of the dome arc AF with the rib portion arc FG lies at a greater radial distance from axis 10*a* than the point of tangency B of the dome arc AB with the foot portion curve BCDE. With the construction shown, it will be apparent that the embodiment of FIG. 7 is useful in connection with a mold which is provided with the movable piston or stem mentioned hereinabove, since the large radius $R_1$ of arc AB permits the piston end to be virtually planar without substantial departure from the configuration of the dome portion.

The following table provides exemplary data with respect to the bottom structure of a bottle having a capacity of 32 fluidounces and constructed in accordance with the embodiment of FIG. 7. In the system of coordinates employed, the x-axis and y-axis may be considered as coincident with interrupted lines 10*b* and 10*a*, respectively, and have a common origin at point 0. Radial lengths are stated in inches and coordinates are stated in inches from the origin.

TABLE

| Point | Coordinates | | Radius | Length |
|---|---|---|---|---|
| | x | y | | |
| A | 0 | 0.422 | $R_1$ | 3.382 |
| B | 0.375 | 0.401 | $R_2$ | 0.549 |
| C | 0.772 | 0.158 | $R_3$ | 0.352 |
| D | 1.066 | 0 | $R_4$ | 0.528 |
| E | 1.594 | 0.528 | $R_5$ | 0.560 |
| F | 0.887 | 0.304 | | |
| G | 1.594 | 0.844 | | |
| H | 0 | −2.960 | | |
| I | 0.336 | −0.141 | | |
| J | 1.066 | 0.352 | | |
| K | 1.066 | 0.528 | | |
| L | 1.034 | 0.844 | | |

In some applications it may be desirable that the lengths of radii $R_3$ and $R_4$ be equal, whereby the curve CDE would consist of a single arc. In such a case it will be apparent that the radial profile of the foot portion will consist of two arcs, namely a concave arc BC and a convex arc CDE, tangent to each other at a point removed from the axially outermost point of the foot portion.

The embodiments represented in FIGS. 6 and 7 are but two of many which may be realized in accordance with the invention and which may vary with variable requirements, various materials, and various forming processes and equipment. It will be recognized that design of specific bottom structures in accordance with the teaching of the invention is readily adaptable to well-known computer programming procedures.

Further, although the foregoing description is concerned with plastic containers, it will be apparent that the invention in its broader aspects may be applied with beneficial results to containers formed of other materials, metal cans for example, particularly those which are subject to internal pressures. Similarly, the invention is not practicable using only molds for blow-molding bottles but may be practiced as well in conjunction with other container-forming matrices such as the female dies employed in metal pressworking operations.

Accordingly, while the invention has been particularly described in connection with certain specific embodiments thereof, it is to be understood that this is by way of illustration and not by way of limitation, and the scope of the appended claims should be construed as broadly as the prior art will permit.

What is claimed is:

1. In a container having a side wall, at least an end portion of the side wall being generally symmetrical about a central axis of the container, and a bottom structure closing the container at the side wall end portion, the outer surface of the bottom structure comprising a central concave dome portion, a convex annular rim portion circumscribing the dome portion and merging therewith and with the side wall end portion, and a plurality of radially oriented foot portions extending axially outwardly of the rim portion, each foot portion having lateral margins merging with the rim portion to form a rib portion between each pair of adjacent foot portions, the radial profile of each foot portion comprising a curve tangent to the radial profile of the dome portion and to the profile of the side wall end portion, the improvement comprising the feature that the foot portion curve comprises a plurality of tangential arcs in series, the radii of curvature of adjacent ones of the lastmentioned arcs being unequal.

2. In a container having a side wall, at least an end portion of the side wall being generally symmetrical about a central axis of the container, and a bottom structure closing the container at the side wall end portion, the outer surface of the bottom structure comprising a central concave dome portion, the radial profile of the outer surface of the dome portion comprising a first concave arc, a convex annular rim portion circumscribing the dome portion and merging therewith and with the side wall end portion, and a plurality of radially oriented foot portions extending axially outwardly of the rim portion, each foot portion having lateral margins merging with the rim portion to form a rib portion between each pair of adjacent foot portions, the radial profile of the rib portion comprising a first curve tangent to the first arc and to the profile of the side wall end portion, the radial profile of each foot portion comprising a second curve tangent to the first arc and to the profile of the side wall end portion, the improvement comprising the feature that the second curve comprises a plurality of tangential arcs in series, the radii of curvature of adjacent ones of the lastmentioned arcs being unequal.

3. In a container according to claim 2, the further improvement comprising the feature that the radius of curvature of each of the last-mentioned arcs is smaller than the radius of curvature of the first arc.

4. In a container having a side wall, at least an end portion of the side wall being generally symmetrical about a central axis of the container, and a bottom structure closing the container at the side wall end portion, the outer surface of the bottom surface comprising a central concave dome portion of substantially spherical form whereby the radial profile of the outer surface thereof comprises a first concave arc having its center of curvature on the axis, a convex annular rim portion circumscribing the dome portion and merging therewith and with the side wall end portion, and a plurality of radially oriented foot portions extending axially outwardly of the rim portion, each foot portion having a radially inner end portion merging with the dome portion, a radially outer end portion merging with the side wall end portion, and lateral margins merging with the rim portion to form a rib portion between each pair of adjacent foot portions, the radial profile of the rib portion comprising a first curve tangent to the first arc and to the profile of the side wall end portion, the radial profile of each foot portion comprising a second curve tangent to the first arc and to the profile of the side wall end portion, the improvement comprising the feature that the second curve comprises a second arc tangent to the first arc, and a third convex arc tangent to the second arc and to the profile of the side wall end portion, the radii of curvature of the second and third arcs being unequal.

5. In a container according to claim 4, the further improvement comprising the feature that the second arc is convex.

6. In a container according to claim 5, wherein the axially outermost point of the foot portions lies in a plane common to the outermost points of the other foot portions and normal to the central axis, the further improvement comprising the feature that the centers of curvature of the second and third arcs lie on a common line parallel with the axis, whereby said outermost point is the point of tangency of the second and third arcs.

7. In a container according to claim 4, the further improvement comprising the feature that each of said radii of curvature is smaller than the radius of curvature of the first arc.

8. In a container according to claim 4, the further improvement comprising the feature that the radius of curvature of the second arc is greater than the radius of curvature of the third arc.

9. In a container according to claim 4, the further improvement comprising the feature that the point of tangency of the first arc with the second arc lies at a greater radial distance from the central axis than the point of tangency of the first arc with the rib portion curve.

10. In a container having a side wall, at least an end portion of the side wall being generally symmetrical about a central axis of the container, and a bottom structure closing the container at the side wall end portion, the outer surface of the bottom structure comprising a central concave dome portion of substantially spherical form whereby the radial profile of the outer surface thereof comprises a first concave arc having its center of curvature on the axis, a convex annular rim portion circumscribing the dome portion and merging therewith and with the side wall end portion, and a plurality of radially oriented foot portions extending axially outwardly of the rim portion, each foot portion having a radially inner end portion merging with the dome portion, a radially outer end portion merging with the side wall end portion, and lateral margins merging with the rim portion to form a rib portion between each pair of adjacent foot portions, the radial profile of the rib portion comprising a first curve tangent to the first arc and to the profile of the side wall end portion, the radial profile of each foot portion comprising a second curve tangent to the first arc and to the profile of the side wall end portion, the improvement comprising the feature that the second curve comprises a second concave arc tangent to the first arc, a third convex arc tangent to the second arc, and a fourth convex arc tangent to the third arc and to the profile of the side wall end portion, the radii of curvature of the third and fourth arcs being unequal.

11. In a container according to claim 10, the further improvement comprising the feature that each of the radii of curvature of the second, third and fourth arcs is smaller than the radius of curvature of the first arc.

12. In a container according to claim 10, the further improvement comprising the feature that the radius of curvature of the fourth arc is greater than the radius of curvature of the third arc.

13. In a container according to claim 10, wherein the axially outermost point of each of the foot portions lies in a plane common to the outermost points of the other foot portions and normal to the central axis, the further improvement comprising the feature that the centers of curvature of the third and fourth arcs lie on a common line parallel with the axis, whereby said outermost point is the point of tangency of the third and fourth arcs.

14. In a container according to claim 10, the further improvement comprising the feature that the point of tangency of the first arc with the rib portion curve lies at a greater radial distance from the axis than the point of tangency of the first arc with the second arc.

15. In a container having a side wall and a bottom structure closing the container at an end portion of the side wall, the outer surface of the bottom structure comprising a central concave dome portion, a convex annular rim portion circumscribing the dome portion and merging therewith and with the side wall end portion, and a plurality of radially oriented foot portions extending axially outwardly of the rim portion, each foot portion having lateral margins merging with the rim portion to form a rib portion between each pair of adjacent foot portions, the radial profile of each foot portion comprising a curve tangent to the radial profile of the dome portion and to the profile of the side wall end portion, the improvement comprising the feature that the foot portion curve comprises a plurality of tangential arcs in series, adjacent ones of the arcs having separate centers of curvature.

* * * * *